US007469119B2

(12) United States Patent
Marsh et al.

(10) Patent No.: US 7,469,119 B2
(45) Date of Patent: Dec. 23, 2008

(54) SYNCHRONOUS DUPLEX PRINTING SYSTEMS WITH INTERMEDIATE TRANSFER MEMBERS

(75) Inventors: Dana G. Marsh, Newark, NY (US); George R. Walgrove, III, Rochester, NY (US); Michael W. Frauens, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/077,615

(22) Filed: Mar. 11, 2005

(65) Prior Publication Data

US 2005/0214039 A1 Sep. 29, 2005

Related U.S. Application Data

(60) Provisional application No. 60/557,514, filed on Mar. 29, 2004.

(51) Int. Cl.
*G03G 15/20* (2006.01)

(52) U.S. Cl. ..... 399/309; 399/299; 399/306; 399/308

(58) Field of Classification Search ..... 399/299, 399/306, 308, 309
See application file for complete search history.

(56) References Cited

U.S. PATENT DOCUMENTS 3,637,306 A * 1/1972 Cooper ..... 399/76
4,035,073 A * 7/1977 Del Vecchio ..... 355/24
4,095,979 A 6/1978 DiFrancesco et al.
4,191,465 A 3/1980 Boase et al.
4,212,529 A 7/1980 O'Brien et al.
4,214,831 A 7/1980 Reesen
4,473,029 A 9/1984 Fritz et al.
4,477,176 A 10/1984 Russel
4,546,060 A 10/1985 Miskinis et al.
5,070,369 A 12/1991 Mahoney et al.
5,070,371 A 12/1991 Randall
5,070,372 A 12/1991 Randall
5,138,363 A 8/1992 Yuge
5,797,077 A * 8/1998 Samizo et al. ..... 399/309
5,799,226 A 8/1998 Shigeta et al.
5,799,236 A 8/1998 Paczkowski
5,826,143 A 10/1998 Haneda et al.
5,835,831 A 11/1998 Staudenmayer et al.

(Continued)

FOREIGN PATENT DOCUMENTS

JP 57-63559 4/1982

(Continued)

OTHER PUBLICATIONS

U.S. Appl. No. 60/551,464, "Powder Coating Apparatus and method of Powder Coating Using An Electromagnetic Brush," filed Mar. 9, 2004, Stelter et al.

*Primary Examiner*—David M Gray
*Assistant Examiner*—Ruth N Labombard
(74) *Attorney, Agent, or Firm*—Donna P. Suchy

(57) ABSTRACT

An imaging system may use electrophotographic processes to synchronously image on both sides of a receiver material, such as in a single pass of the receiver material through the imaging system. The system may include intermediate transfer members, which may be split rollers or non-split rollers. The intermediate transfer members may hold one image, or they may be 2-up or greater rollers that hold multiple images.

8 Claims, 8 Drawing Sheets

U.S. PATENT DOCUMENTS

| | | | | | |
|---|---|---|---|---|---|
| 5,899,611 | A | | 5/1999 | Haneda et al. | |
| 5,905,931 | A | | 5/1999 | Shigeta et al. | |
| 5,930,572 | A | | 7/1999 | Haneda et al. | |
| 5,970,277 | A | | 10/1999 | Shigeta et al. | |
| 5,991,563 | A | | 11/1999 | Haneda et al. | |
| 6,032,015 | A | * | 2/2000 | Umeda et al. | 399/306 |
| 6,038,410 | A | | 3/2000 | Iriyama | |
| 6,097,921 | A | * | 8/2000 | Kageyama | 399/306 |
| 6,597,887 | B2 | * | 7/2003 | Sakai et al. | 399/309 |
| 7,391,425 | B2 | * | 6/2008 | Marsh et al. | 399/309 |
| 2004/0142271 | A1 | * | 7/2004 | Stulc et al. | 399/308 |

FOREIGN PATENT DOCUMENTS

| | | |
|---|---|---|
| JP | 58-156976 | 9/1983 |
| JP | 61-249065 | 6/1986 |
| JP | 62-50868 | 5/1987 |

* cited by examiner

SYNCHRONOUS DUPLEX PRINTING SYSTEMS WITH INTERMEDIATE TRANSFER MEMBERS

CROSS REFERENCE TO RELATED APPLICATION

This is a 111A application of Provisional Application Ser. No. 60/557,514, filed Mar. 29, 2004, entitled SYNCHRONOUS DUPLEX PRINTING SYSTEMS by Dana G. Marsh, et al.

FIELD OF THE INVENTION

The invention generally relates to electrophotographic printers. More specifically, it relates to the synchronous transfer of images onto both sides of a receiver material.

BACKGROUND OF THE INVENTION

Electrographic and electrophotographic processes form images on selected receivers, typically paper, using small dry colored particles called toner. The toner usually comprises a thermoplastic resin binder, dye or pigment colorants, charge control additives, cleaning aids, fuser release additives, and optionally flow control and tribocharging control surface treatment additives. The thermoplastic toner is typically attached to a print receiver by a combination of heating and pressure using a fusing subassembly that partially melts the toner into the fibers at the surface of the receiver.

Typically, in an electrographic or electrophotographic printer or copier (collectively referred to herein as "printers"), a heated fuser roller/pressure roller nip is used to attach and control the toner image to a receiver. Heat can be applied to the fusing rollers by a resistance heater, such as a halogen lamp. And, it can be applied to the inside of at least one hollow roller and/or to the surface of at least one roller. At least one of the rollers in the heated roller fusing assembly is usually compliant, and when the rollers of the heated roller fusing assembly are pressed together under pressure, the compliant roller then deflects to form a fusing nip.

Most heat transfer between the surface of the fusing roller and the toner occurs in the fusing nip. In order to minimize "offset," which generally refers to the amount of toner that adheres to the surface of the fuser roller, release oil is typically applied to the surface of the fuser roller. Release oil is generally made of silicone oil plus additives that improve the attachment of the release oil to the surface of the fuser roller and that also dissipate static charge buildup on the fuser rollers or fused prints. During imaging, some of the release oil attaches to the imaged and background areas of the fused prints.

The toner image resident on the surface of the imaging member, such as a photosensitive member or dielectric insulating member, may be transferred to a receiver material using a variety of different methods. For example, the transfer may be a direct transfer to the receiver material. Alternatively, the transfer may be an intermediate transfer in which toner is first transferred to an intermediate transfer medium and then transferred a second time in a second transfer station to the final receiver material. Other methods might also be used.

Various printers might have different printing capabilities depending on their design and their particular operational configurations. For example, different printers might have different imaging speeds. Some printers might be designed for low-capacity use and therefore might only be capable of imaging a relatively small number of pages within a given amount of time. Other printers, however, might be designed for high-capacity use and therefore might be capable of imaging a relatively large number of pages within the same amount of time.

In another example of differing print capabilities, some printers might only be capable of printing on a single side of a receiver material. Printing on a single side of a receiver medium is oftentimes referred to as simplex printing. Other printers might be capable of printing on both sides of a receiver material, which is oftentimes referred to as duplex printing. Duplex printing may be used in a variety of different applications, such as commercial printing applications and other high-volume applications. However, it might also be used in low-volume applications and non-commercial applications.

Conventional duplex imaging systems, however, may have various disadvantages. For example, many conventional duplex imaging systems require the receiver to pass through the system multiple times. U.S. Pat. No. 4,095,979 teaches transferring a first image to a first side of a copy sheet, inverting the copy sheet while the first image thereon remains unfixed, transferring the second unfixed image to the second side of the copy sheet, and then transporting the copy sheet with the first and second unfixed images to a fixing station.

U.S. Pat. Nos. 4,191,465, 4,212,529, 4,214,831, 4,477,176, 5,070,369, 5,070,371, 5,070,372, and 5,799,236 all teach the use of inverters, turn around drums, turn over stations and the like that require a receiver to make multiple passes through the system in order to image on both sides of the receiver. These systems, and others like them, require special handling of the receiver, which can reduce the speed with which the systems can perform duplex imaging.

U.S. Pat. Nos. 5,799,226, 5,826,143, 5,899,611, 5,905,931, 5,970,277, 5,930,572, 5,991,563, and 6,038,410 generally pertain to an apparatus in which a single photoconductor carrying a toner image comes into contact with a single intermediate transfer belt and transfers the image to the intermediate transfer belt at a first transfer station using a corona device. The intermediate transfer belt temporarily holds the first image and transports it in a similar fashion to permit the transfer of a second image from the photoconductor to the top side of a receiver sheet at a first transfer station.

The belt then carries the receiver sheet with the top side image to a second transfer station at which the first image on the intermediate transfer belt is transferred to the bottom side of the receiver sheet. The receiver sheet with duplex images is then transported to a fixing station. Because the intermediate transfer belt temporarily holds the first image for a period of time representing one cycle of the intermediate transfer belt, the speed with which these systems can perform duplex imaging may also be limited. This can be disadvantageous for high-volume and high-speed imaging applications.

Therefore, there exists a need for improved systems for duplex imaging.

SUMMARY OF THE INVENTION

An imaging system may synchronously image on both sides of a receiver material. For example, the imaging system may image on both sides of the receiver material in a single pass of the receiver material through the imaging system.

The imaging system may include photoconductors and use electrophotographic processes to image on the receiver material. The photoconductors may operate using discharged area development ("DAD") mode, charged area development ("CAD") mode, or a combination of the two modes.

In exemplary embodiments, the imaging system may use intermediate transfer members that can hold a single image or can be 2-up or greater rollers. They may also be split rollers or non-split rollers.

These as well as other aspects and advantages of the present invention will become apparent from reading the following detailed description, with appropriate reference to the accompanying drawings.

BRIEF DESCRIPTION OF THE DRAWINGS

Exemplary embodiments of the present invention are described herein with reference to the drawings, in which.

DETAILED DESCRIPTION OF EXEMPLARY EMBODIMENTS

Figure 1:
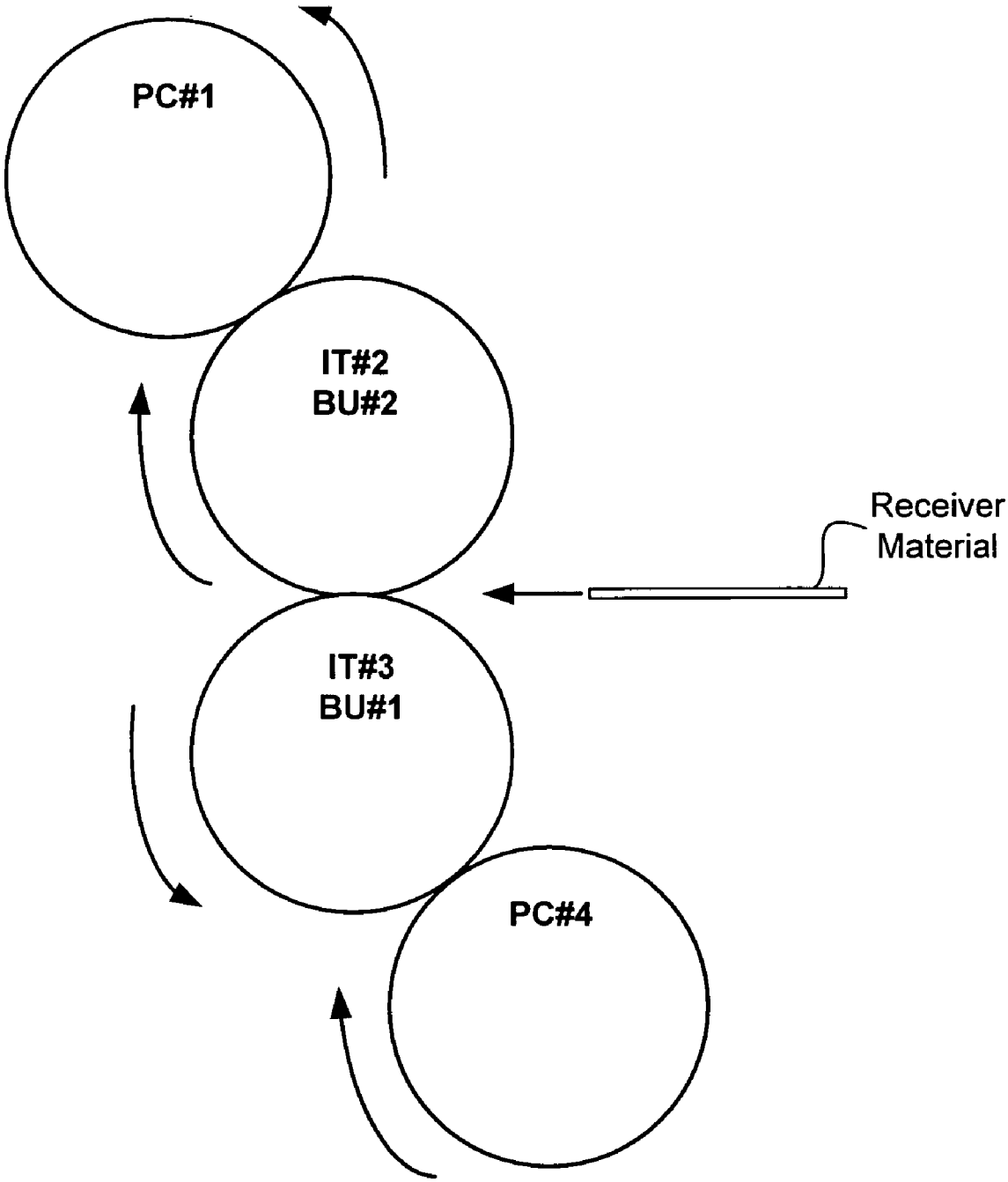
FIG. 1 is a block diagram of an exemplary double-sided image formation system in which images can be created on both sides of a receiver material in a single pass of the receiver material.

Electrographic or electrophotographic copiers or printers (collectively referred to herein as "printers") are used in a variety of different imaging applications. Various different architectures might be used for these systems. These architectures may depend on the particular methods used to transfer an image to a receiver material as well as the particular imaging mode(s) supported by the printer. While the examples herein may generally refer to printers, it should be understood that they may also apply to copiers, offset press systems, lithographic press systems and various other imaging systems.

They may also apply to other powder deposition systems, some of which may be capable of printing on metals. Powder deposition devices and techniques are discussed in co-pending U.S. Provisional Patent Application Ser. No. 60/551,464, titled "Powder Coating Apparatus and Method of Powder Coating Using an Electromagnetic Brush," filed on Mar. 9, 2004, which is commonly assigned, and which is incorporated herein by reference.

A printer may support imaging on one side of an image receiver material (e.g., simplex mode or simplex printing). The printer might additionally support synchronously imaging on both sides of the image receiving material (e.g., duplex mode or duplex printing). That is, the printer may make an image on one side of the receiver material, or the printer may make images on both sides of the receiver material. Printers may support one or both of these different printing modes.

In exemplary architectures, the printer can be a single pass printer. In this type of printer, the receiver material might only need to pass through the printer once in order to simultaneously image on the both sides of the receiver material. As discussed herein, various exemplary printers might employ architectures and methods that use a reduced number of internal steps in order to image on both sides of the receiver material. This might advantageously increase the speed with which the printer can perform duplex printing.

In one exemplary embodiment, the printer is a single pass, duplex mode printer that uses two photosensitive photoconductors drums and two intermediate transfer drums, but the printer does not use any secondary transfer rollers. Implementing the system without secondary transfer rollers can advantageously reduce the number of steps needed to transfer an image to both sides of the receiver material, which can provide improved process speeds over conventional systems that use secondary transfer rollers or other such intermediate processing steps.

The printer might use various different types of intermediate transfer members, such as intermediate transfer drums. In one embodiment, the printer uses 2-up split intermediate transfer members. A 2-up split member generally has two separate portions that can be independently biased and that can carry separate images. While the two separate portions are generally halves of the 2-up split member, non-symmetric portions might also be used. The independent nature of the two portions allows them to be biased to different voltages. Thus, the two portions of one 2-up split member might be simultaneously biased to different voltages or to the same voltage.

In the examples discussed herein, the split rollers are depicted and described as 2-up split rollers. That is, the split rollers have two distinct electrical regions. However, the split rollers may alternatively be divided into three or more distinct electrical regions, and each of the three or more distinct electrical regions may be independently biased. Note that these rollers (n) would be referred to as 3-up or n-up split rollers.

Other embodiments might use intermediate transfer members that are not split members. A non-split intermediate transfer member generally comprises a single portion that is biased to one particular voltage. In other embodiments, combinations of 2-up split intermediate transfer rollers and non-split intermediate transfer rollers might be used.

The printer might use a variety of different methods to transfer images to the receiver material. For example, the printer might use various electrophotographic processes that employ toner or other magnetic carriers in order to create an image on one or both sides of the receiver material. Exemplary development systems that implement hard magnetic carriers are described in U.S. Pat. Nos. 4,473,029 and 4,546,060, the contents of which are incorporated by reference as if fully set forth herein. Other development systems implement magnetic carriers that are not hard (i.e. soft), and these may also be used. In these systems, the toning shell and/or toning magnet may or may not rotate, and other variations are also possible.

FIG. 1 is a block diagram of an exemplary double-sided image formation system in which images can be created on both sides of a receiver material in a single pass of the receiver material. The receiver material may be any type of receiver material, such as paper, overhead projector ("OHP") transparency materials, envelopes, mailing labels, and sheetfed offset or webfed offset preprinted shells, metals, metalized substrates, semi-conductors, fabrics or other materials. In this exemplary system, the receiver material is transported through the transfer station only once, and the image transfer to both sides of the receiver material occurs synchronously during this single pass. This can advantageously allow the system to maintain a relatively high process speed during duplex printing.

Various different imaging methods might be used. For example, the system might use electrophotographic development processes, such as discharged area development ("DAD"), charged area development ("CAD") or a combination of the two methods. In one embodiment, both photoconductors might operate in the DAD mode or they both might operate in the CAD mode. Alternatively, one photoconductor using negatively charged toner might operate in the DAD mode, while the other photoconductor using positively charged toner might operate in the CAD mode. Other methods, such as directed aerosol toner development or other direct electrostatic printing processes, might also be used.

The particular architecture of the system may vary depending on the particular imaging process and the particular implementation of that imaging process used by the system. For example, this figure illustrates an exemplary drum architecture. However, a photoconductor belt, a continuous flexible seamless dielectric belt or other architectures might alternatively be used.

As illustrated in FIG. 1, the system includes two imaging members. These two imaging members are labeled PC#1 (imaging member #1) and PC#4 (imaging member #4), respectively. The imaging members might vary depending on the particular imaging processes. If the system uses an electrophotographic process, then the two imaging members might be photoconductors, as are depicted in FIG. 1. However, if the system uses direct electrostatic printing or another such process, then the imaging members might not be photoconductors but rather might be some other type of imaging member that is appropriate for that process.

The system also includes two intermediate transfer members, which are labeled IT#2 (intermediate transfer member #2) and IT#3 (intermediate transfer member #3), respectively. Each imaging member works together with its respective intermediate transfer member to image on one side of the receiver material. The first imaging member (PC#1) and the first intermediate transfer member (IT#2) which acts as a back-up roller (BU#2) for the second intermediate transfer member (IT#3) to form a transfer nip, image on the first side of the receiver material, while the second intermediate transfer member (IT#3) which acts as a backup roller (BU#1) for the first intermediate transfer member (IT#2) so that IT#2 and IT#3 essentially serve two purposes and the second imaging member (PC#4) image on the other side of the receiver material.

Dry toner images on the surfaces of the imaging members PC#1, PC#4 can be transferred to the intermediate transfer members IT#2, IT#3. As illustrated, the first intermediate transfer member IT#2 serves as a backup roller for the second intermediate transfer member IT#3 in the paper transfer nip. Similarly, the second intermediate transfer member IT#3 serves as a backup roller for the first intermediate transfer member IT#2 in the paper transfer nip.

The process speed is generally determined from the surface speed of the intermediate transfer members IT#2, IT#3. The intermediate transfer members IT#2, IT#3 preferably operate at the same velocity, such as at the same angular velocity. The intermediate transfer members IT#2, IT#3 preferably have the same diameter, and therefore also have the same surface velocity in addition to having the same angular velocity. The image members PC#1, PC#4 preferably have the same velocity as the intermediate transfer members IT#2, IT#3, such that all four members PC#1, IT#2, IT#3, PC#4 then rotate at the same velocity.

In one preferred embodiment, the imaging members PC#1, PC#4 are a 2-up roller, which is one roller, as shown in FIGS. 2-7. with two independent areas that have distinct electrically contiguous surfaces, and the two intermediate transfer members IT#2, IT#3 are also each a 2-up split roller, also referred to as a 2-up split member. The total surface area of each of the split roller is split or separated into two equal areas with distinct and electrically isolated regions. One half of each cylindrical split roller may be biased to one voltage, while the other half may be biased to a different voltage. Thus, the voltages of the two halves of one split roller may be the same or different.

The two intermediate transfer members IT#2, IT#3 form a single toning nip that is used to synchronously image on both sides of the receiver material. For example, the toner images on one of the split surfaces of the first intermediate transfer member IT#2 can be transferred under the influence of an electric field to one side of the receiver material. Similarly, the toner image on one of the split surfaces of the second intermediate transfer member IT#3 can synchronously be transferred to the other side of the receiver material through another electric field.

The double-sided transfer of toner images from the 2-up imaging members PC#1, PC#4 to the 2-up split intermediate transfer members IT#2, IT#3 and finally to both sides of the receiver material can operate at the full process speed capability of the printer, since the 2-up split intermediate transfer members IT#2, IT#3 are not required to temporarily transport the image frame for a second cycle in order to synchronize the transfer of the two images. Also, the synchronous transfer of images to both sides of the receiver material in a single transfer nip defined by the contact of the two image transfer members advantageously does not require more than one transfer station.

I. EXAMPLE 1

Hybrid Split Roller Duplex Printing Using DAD/DAD Modes

This example illustrates an exemplary four-roller system for duplex printing that uses DAD/DAD modes. In this exemplary embodiment, the intermediate transfer members IT#2, IT#3 are 2-up split rollers, and identical development stations using negatively charged toner (e.g., DAD modes) are used to develop real toner images onto the surfaces of the two 2-up photoconductors PC#1, PC#4.

Each region or frame of the different rollers in this exemplary four roller system may carry a constant, unchanging dc voltage. The dc voltages are preferably selected to permit the development of negatively charged toner onto the surface of photoconductors PC#1, PC#4 and to enable the transfer of the negatively charged toner onto the surface of the 2-up split intermediate transfer members IT#2, IT#3. The selected voltages are also preferably selected to permit the synchronous duplex transfer of the toner on the surface of the 2-up split intermediate transfer rollers IT#2, IT#3 onto both sides of a receiver passing through the nip formed between the two 2-up split intermediate transfer rollers IT#2, IT#3.

In various embodiments, the negatively charged toner on the surface of the second 2-up split intermediate transfer roller IT#3 is subjected to an additional charging step or other polarity changing step in order to change the sign of the toner from negative to positive prior to the toner entering the nip formed between the two 2-up split intermediate transfer rollers IT#2, IT#3. However, other embodiments may alternatively change the sign of the toner on the first 2-up split intermediate transfer roller IT#2 rather than the sign of toner on the second 2-up split intermediate transfer roller IT#3.

In addition to the imaging rollers PC#1, PC#4 and intermediate transfer rollers IT#2, IT#3 described in these embodiments, electrophotographic systems may include various other components. For example, electrophotographic systems may also include charging subsystems that place a uniform surface charge density onto the photoconductor imaging rollers prior to exposure. They may also include exposure subsystems, such as optical systems, laser scanning (e.g., raster output scanner) systems, and light emitting diode arrays (LED's), that are used to selectively discharge the uniform surface charge density to create a latent image of charges that are developed to create real toner images using any one of a variety of development subsystem means.

The development subsystems are themselves subjected to developer bias set points that are generally set to ensure that uniform and appropriate toner development occurs. Thus, the surfaces of photoconductors, and the conducting substrates (ground planes) of photoconductors may involve different voltage biases. In addition to the charging and exposure subsystems, other subsystems may be employed including: cleaning subsystems for the photoconductors, fuser rollers, and development rollers; fusing subsystems, and erase subsystems. The biases for these systems might be adjusted based on various operational factors and therefore might vary from system to system.

Various biases might be used for the system. In one preferred embodiment, the surfaces of the two photoconductors PC#1, PC#4 may both be charged to a uniform −600 V dc. Exposed areas may be discharged to −125 V dc to create a spatially modulated latent image, and the developer bias may be set to −490 V dc to ensure appropriate and uniform development creating a real toner image. The conducting substrates of the photoconductors PC#1, PC#4 may be biased to machine ground.

The system may use different cycles, such as image and transfer cycles, to image onto the receiver material. Exemplary cycles for this system are described in more detail below and with reference to FIGS. 2-4, which illustrate preferred biases that might be used during the respective cycles. The solid black arrows generally located within the rollers show the electric field vectors corresponding to the particular biases, while the thinner black arrows generally located around the rollers show the direction of physical rotation of the rollers.

A. Cycle 1—Image Cycle

Figure 2:
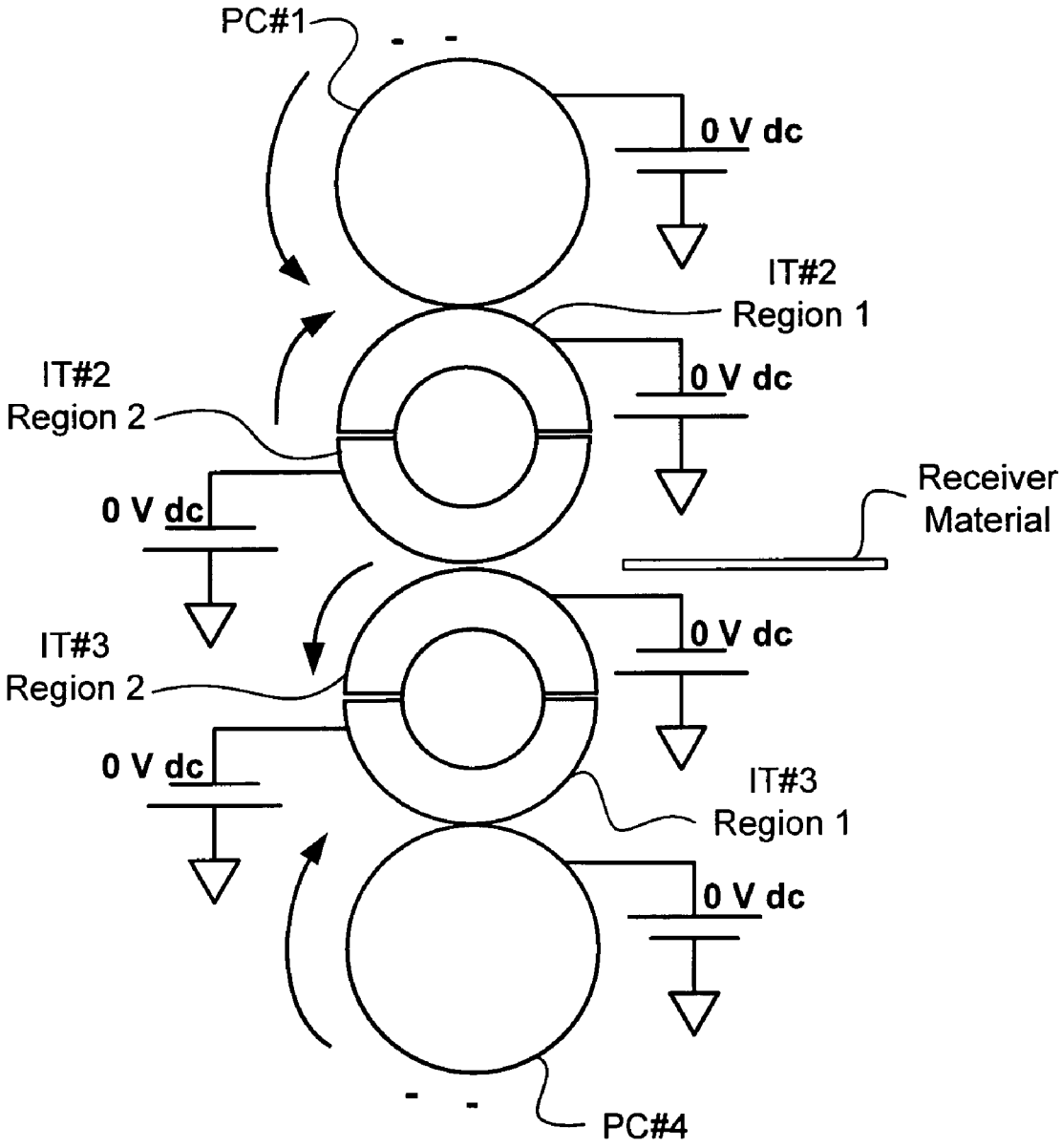
FIG. 2 illustrates an exemplary imaging cycle for a hybrid split roller imaging system using DAD/DAD modes.

FIG. 2 illustrates an exemplary imaging cycle for a hybrid split roller imaging system using DAD/DAD modes. During the imaging cycle, negative toner is imaged onto the surface of both photoconductors PC#1, PC#4. The conducting substrates of the two photoconductors PC#1, PC#4, and the conducting substrates for regions 1 and 2 of the 2-up split intermediate transfer members IT#2, IT#3 are all biased to 0 V dc, which in this example is ground.

In this example, all voltages are with respect to ground, which is 0 V dc. However, it should be understood that the different rollers in this or other examples might be biased with respect to voltages other than ground. Also, the particular biases described in this and the other examples are merely exemplary in nature, and other biases might also be used.

B. Cycle 2—Transfer to Intermediate Transfer Roller

Figure 3:
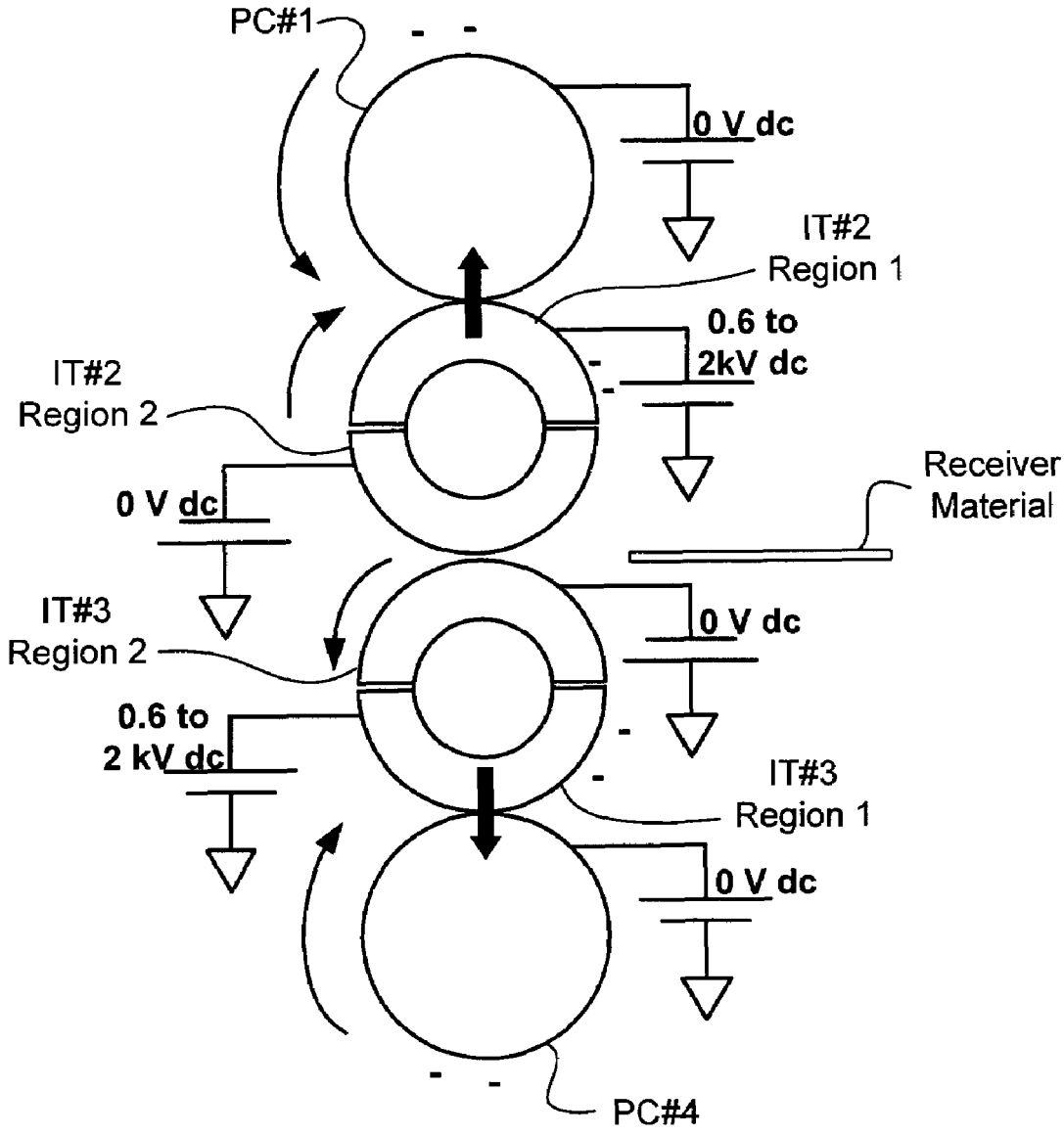
FIG. 3 illustrates an exemplary first transfer cycle for a hybrid split roller imaging system using DAD/DAD modes.

FIG. 3 illustrates an exemplary first transfer cycle for a hybrid split roller imaging system using DAD/DAD modes. In this transfer cycle, negative toner on the photoconductors PC#1, PC#4 is transferred to region 1 of each respective 2-up split intermediate transfer member IT#2, IT#3.

A positive voltage bias of approximately 0.6 to 2 kV dc is applied to the conducting substrate of region 1 of each 2-up split intermediate transfer member IT#2, IT#3. This biasing establishes an electric field gradient across the nip between the photoconductors IT#1, IT#4 and the 2-up split intermediate transfer members IT#2, IT#3. The electric field gradient enables the negatively charged toner to transfer from the photoconductors PC#1, PC#4 to the surfaces of the 2-up split intermediate transfer members IT#2, IT#3.

C. Cycle 3—Transfer of Toner to Receiver

Figure 4:
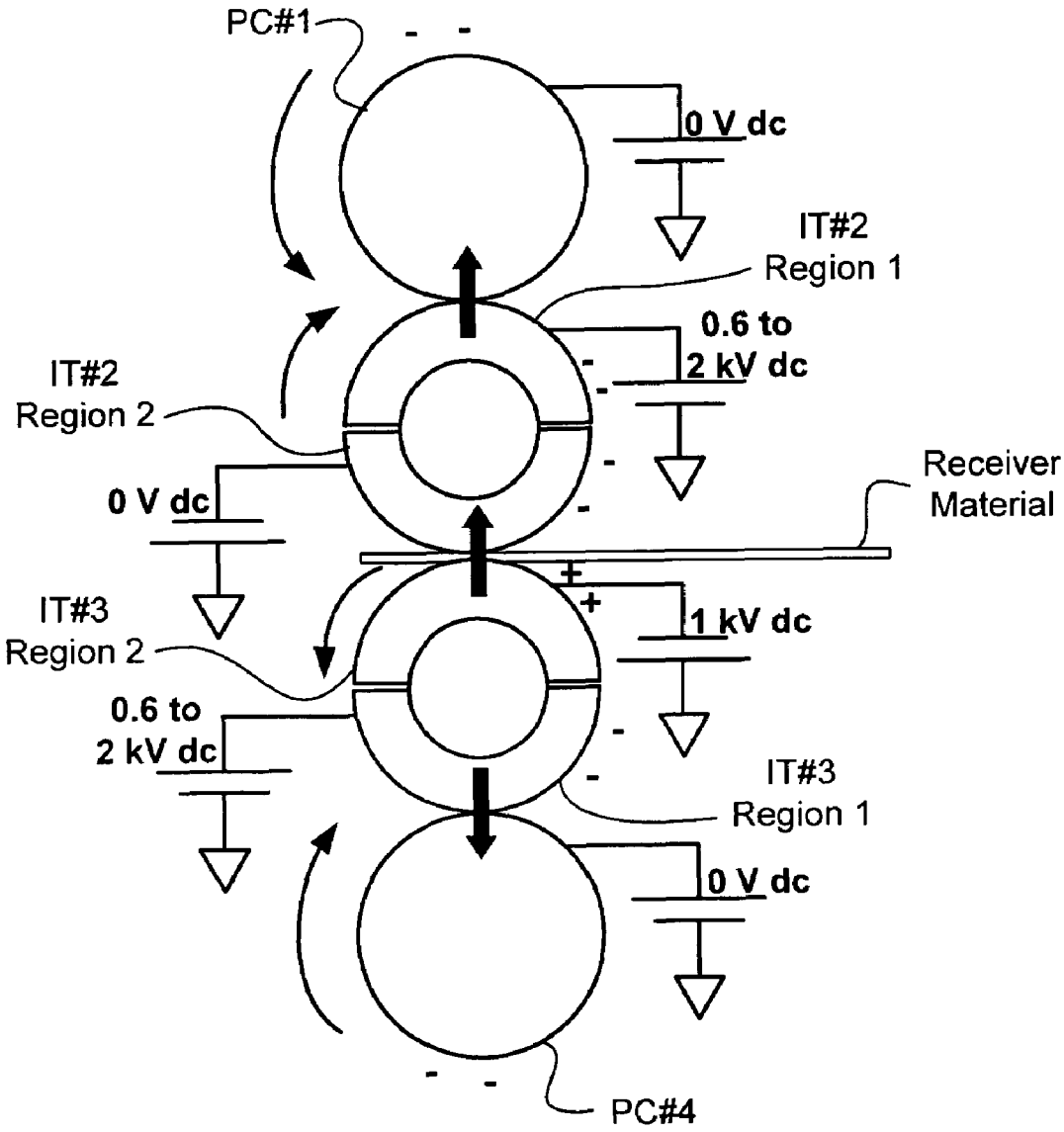
FIG. 4 illustrates an exemplary second transfer cycle for a hybrid split roller imaging system using DAD/DAD modes.

FIG. 4 illustrates an exemplary second transfer cycle for a hybrid split roller imaging system using DAD/DAD modes. In this cycle, region 2 of the second intermediate transfer member is biased to 1 kV dc. A corona device or other polarity changing device may be used to change the charge of the negative toner on the surface of the second 2-up split intermediate transfer member IT#3 to a positive charge, and this is preferably done prior to the arrival of the toner on the surface of the second 2-up split intermediate transfer member IT#3 to the nip formed between the two 2-up split intermediate transfer members IT#2, IT#3.

A 1 kV voltage difference exists between regions 2 of the two 2-up split intermediate transfer rollers IT#2, IT#3. This establishes an electric field gradient across the receiver and enables the negative and positive toner to transfer from the surfaces of the 2-up split intermediate transfer members IT#2, IT#3 to both sides of the receiver in a synchronous manner.

This embodiment advantageously only requires one kind of toner to develop the negative toner onto the surfaces of the photoconductors PC#1, PC#4. Controlling the voltage bias on the individual members is generally easier than dealing with two different toners (e.g., a negative and a positive toner) and the different development systems that would then be required.

A fourth cycle, which is identical to the third cycle, may be used to complete the transfer of four images to both sides of two duplex pages.

II. EXAMPLE 2

Hybrid Split Roller Duplex Printing Using DAD/CAD Modes

This example illustrates an exemplary four-roller system for duplex printing that uses DAD/CAD modes. In this example the intermediate transfer members IT#2, IT#3 are 2-up split rollers. The development of toner onto the surface of the first photoconductor roller PC#1 uses negatively charged toner and the DAD mode while the development of toner onto the surface of the second photoconductor PC#4 uses positively charged toner and the CAD mode. Although this example illustrates two different development stations with differently charged toners, it advantageously does not require the use of an additional polarity changing device to convert negatively charged toner to positively charged toner.

A. Cycle 1—Image Cycle

Figure 5:
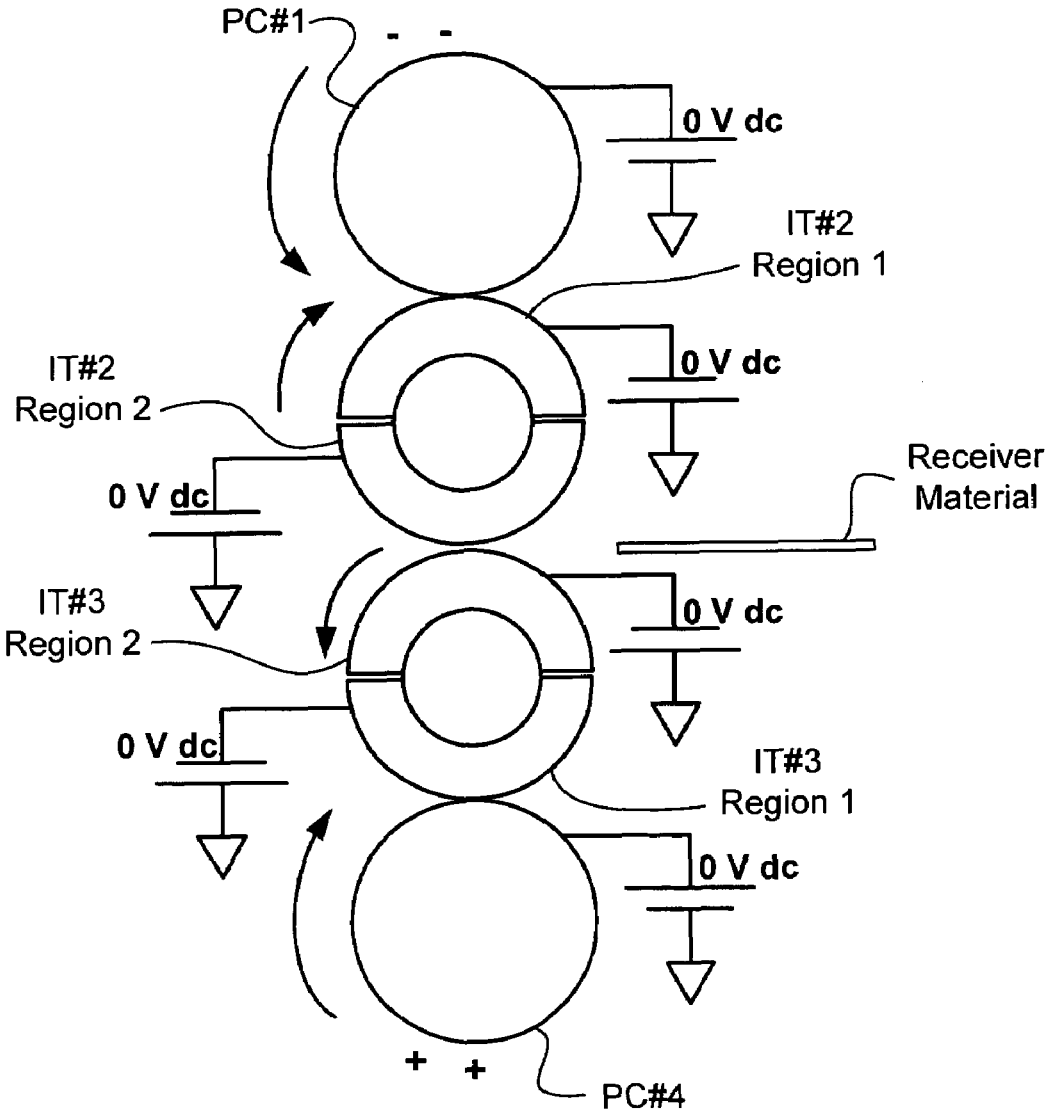
FIG. 5 illustrates an exemplary imaging cycle for a hybrid split roller imaging system using DAD/CAD modes.

FIG. 5 illustrates an exemplary imaging cycle for a hybrid split roller imaging system using DAD/CAD modes. In the imaging cycle, negative toner is imaged onto the surface of the first photoconductor PC#1 using DAD. The conducting substrate (ground plane) of the photoconductor is biased to 0 V dc. The photoconductor surface is charged to −600 V dc, exposed with light to discharge the surface potential down to −125 V dc, and the developer bias is set to −490 V dc. Negative toner is attracted to the discharged areas (−125 V dc) on the surface of the photoconductor.

Positive toner is imaged onto the surface of the second photoconductor PC#4 using CAD. The conducting substrate of the photoconductor is biased to 0 V dc. The surface of photoconductor PC#4 is charged to −600 V dc, exposed with light to discharge the surface potential down to −125 V dc, and the developer bias is set to −490 V dc. Positive toner is attracted to the charged areas (−600 V dc) of the photoconductor.

B. Cycle 2—Transfer to Intermediate Transfer Roller

Figure 6:
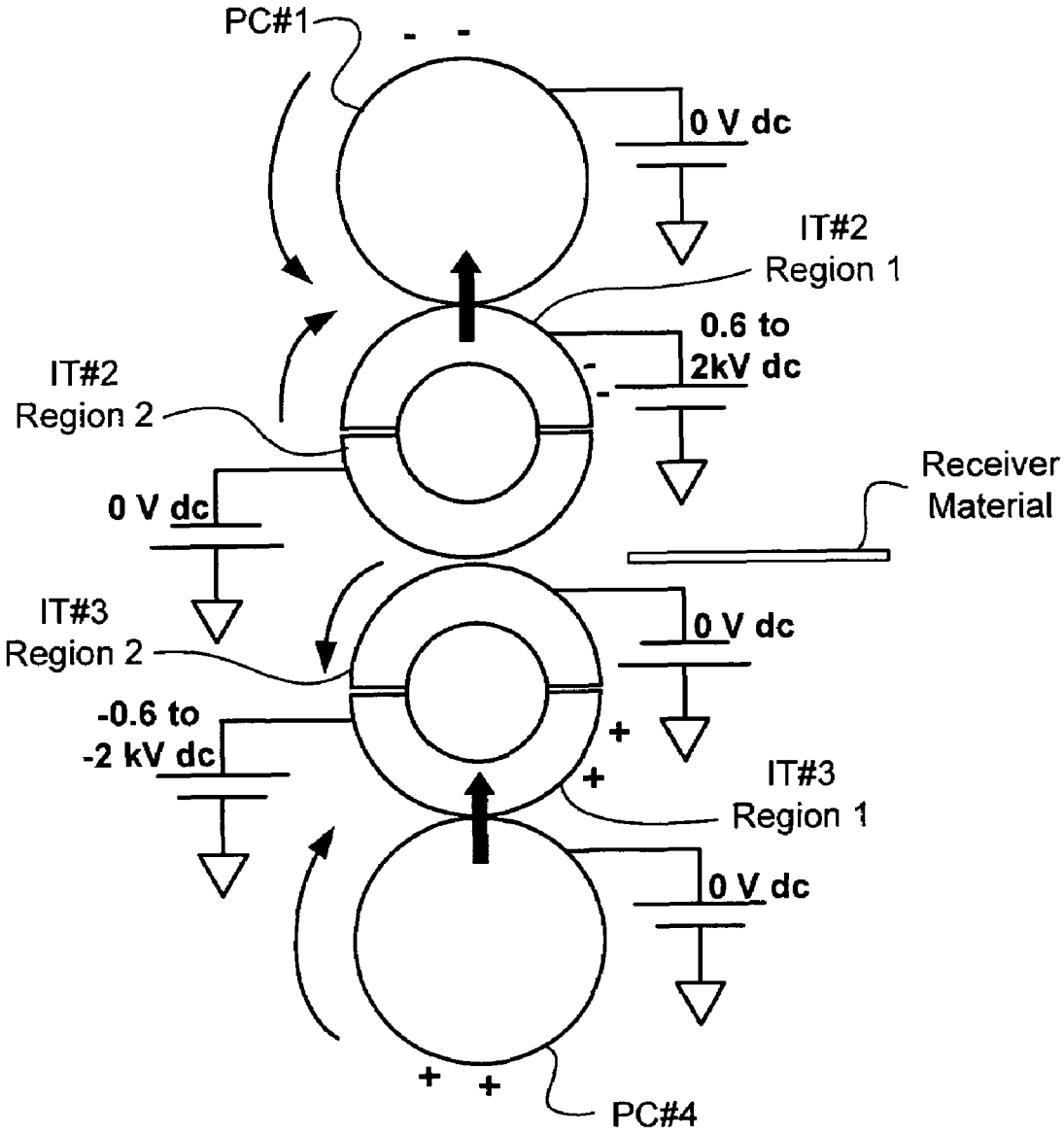
FIG. 6 illustrates an exemplary first transfer cycle for a hybrid split roller imaging system using DAD/CAD modes.

FIG. 6 illustrates an exemplary first transfer cycle for a hybrid split roller imaging system using DAD/CAD modes. In this cycle, region 1 of the first 2-up split intermediate transfer member IT#2 is biased between approximately 0.6 and 2.0 kV dc. This provides a voltage gradient and an electric field that enables the negative toner on the first photoconductor PC#1 to be attracted to region 1 of the first 2-up split intermediate transfer member IT#2.

Region 1 of the second 2-up split intermediate transfer member IT#3 is biased to between negative 0.6 and negative 2.0 kV dc. This similarly provides a voltage gradient and an electric field that enables the positive toner on the second photoconductor PC#4 to be attracted to region 1 of the second 2-up split intermediate transfer member IT#3.

C. Cycle 3—Transfer of Toner to Receiver

Figure 7:
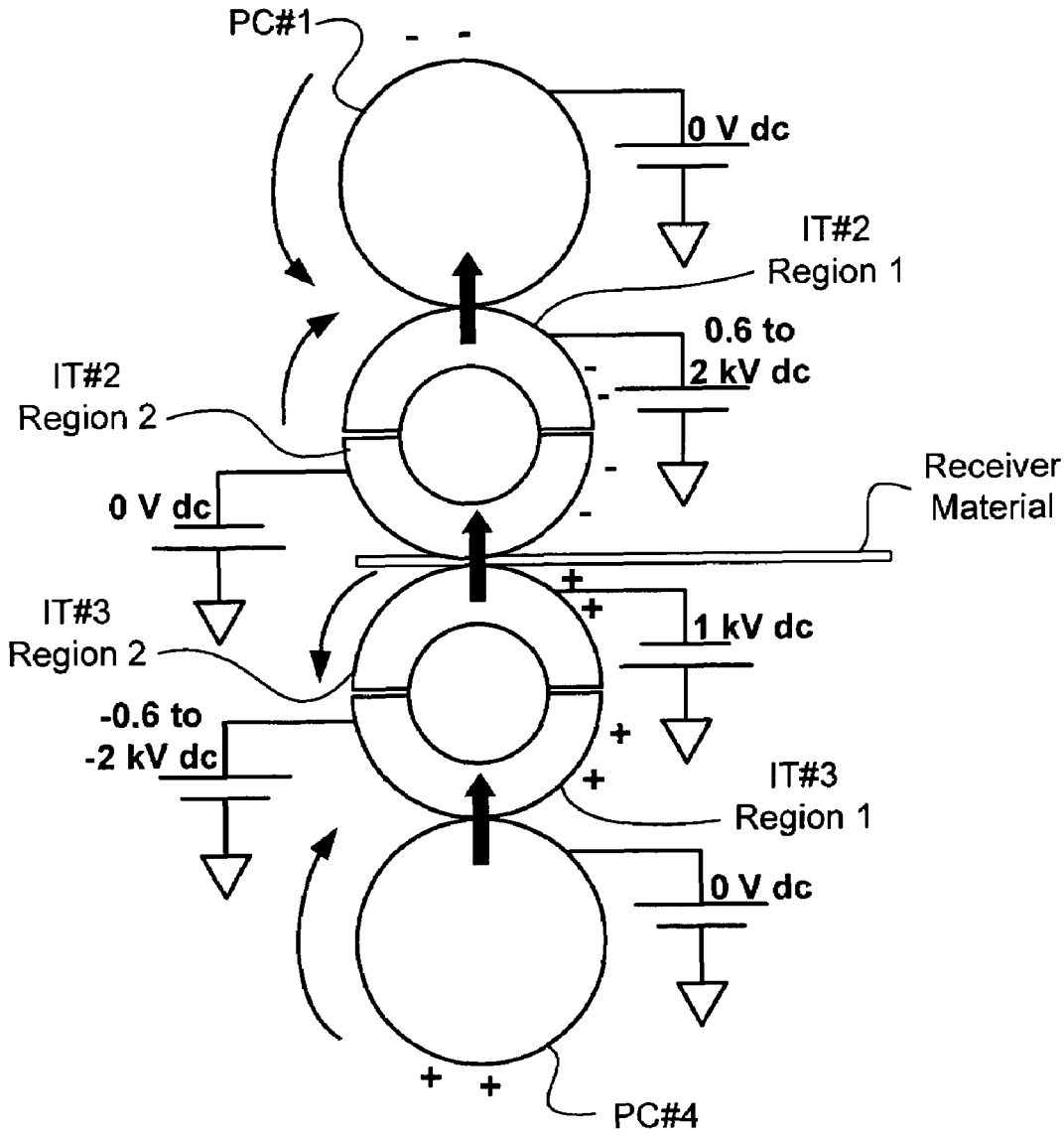
FIG. 7 illustrates an exemplary second transfer cycle for a hybrid split roller imaging system using DAD/CAD modes.

FIG. 7 illustrates an exemplary second transfer cycle for a hybrid split roller imaging system using DAD/CAD modes. In this cycle, region 2 of the second 2-up split intermediate transfer member IT#3 is additionally biased to 1 kV dc. This creates a voltage difference of 1 kV dc between regions 2 of the two 2-up split intermediate transfer members IT#2, IT#3. The voltage difference establishes an electric field gradient across the receiver, which enables the negative and positive toner to transfer from the surfaces of the 2-up split intermediate transfer members IT#2, IT#3 to both sides of the receiver in a synchronous manner.

A fourth cycle, which is similar to cycle 3, can be used to complete the transfer of four images to both sides of two duplex pages.

III. EXAMPLE 3

Synchronous Duplex Printing

The previous examples illustrate exemplary systems where the 2-up intermediate transfer members IT#2, IT#3 are 2-up split members. Other embodiments, such as the ones described in this example, however, might not use split members. In this example, one photoconductor uses DAD mode, while the other photoconductor uses CAD mode. It should be understood, however, that both photoconductors might alternatively use the same development mode.

Figure 8:
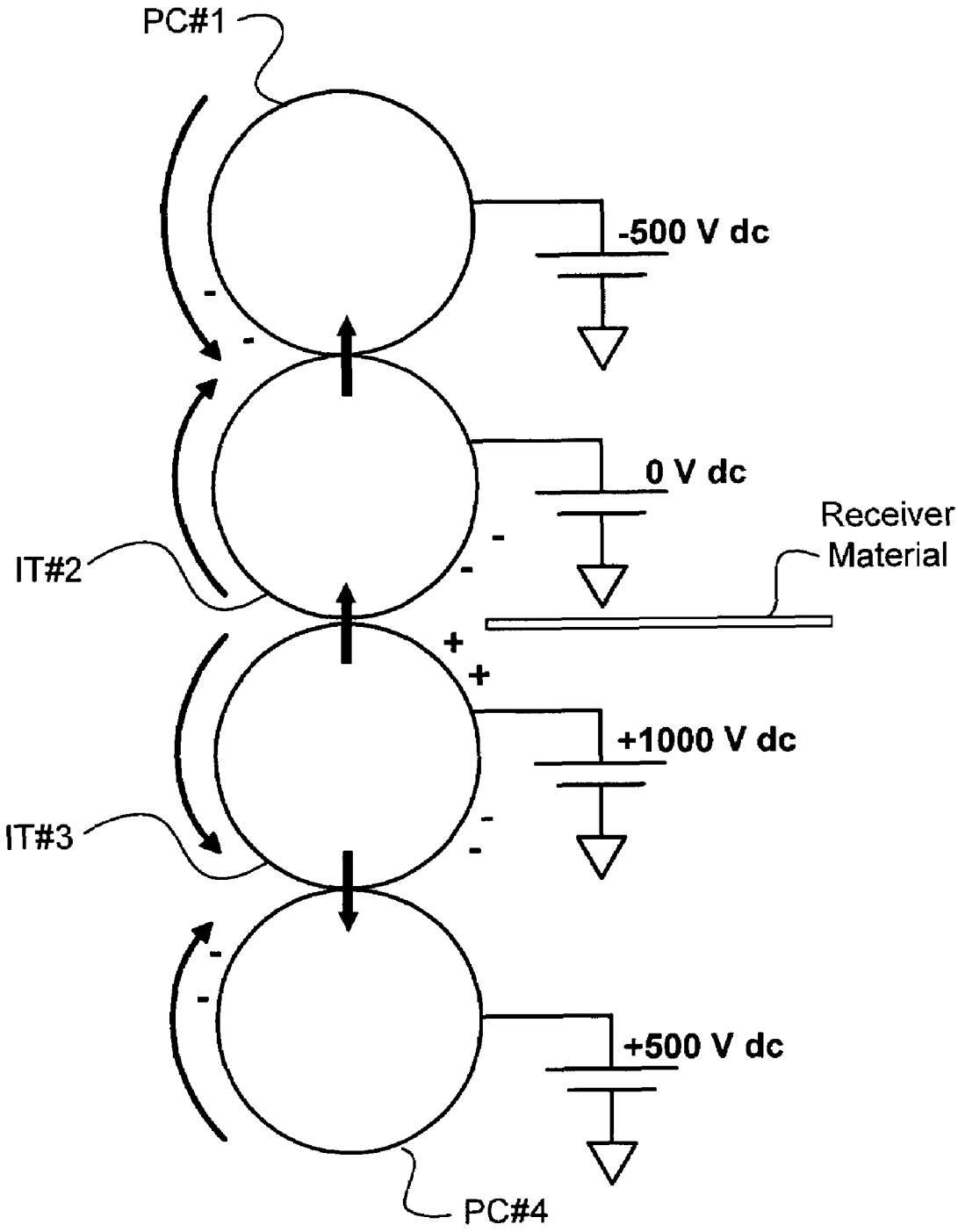
FIG. 8 illustrates an exemplary biasing for a synchronous imaging system that uses DAD/CAD modes.

FIG. 8 illustrates an exemplary biasing for a synchronous imaging system that uses DAD/CAD modes. The development of toner onto the surface of the first photoconductor PC#1 uses DAD mode, while the development of toner onto the surface of the second photoconductor PC#4 uses CAD mode.

The first photoconductor PC#1 is biased to negative 500 V, and the first intermediate transfer member IT#2 is biased to 0 V. This creates a 500 volt difference between the first photoconductor roller PC#1 and the first intermediate transfer member IT#2, which enables the negatively charged toner on the surface of the first photoconductor PC#1 to transfer to the surface of the first intermediate transfer member IT#2.

The second photoconductor PC#4 is biased to 500 V, and the second intermediate transfer member IT#3 is biased to 1000 V. Therefore, a 1000 V difference exits between the first and second intermediate transfer members IT#2, IT#3. This voltage difference establishes an electric field between the two members IT#2, IT#3. The electric field enables the negatively charged toner on the surface of the first intermediate transfer roller IT#2 to transfer to one side of the receiver sheet in the nip between members IT#2, IT#3. At the same time, the positively charged toner on the surface of second intermediate transfer member IT#3 is transferred to the other side of the receiver under the influence of the electric field across the receiver in the nip.

A corona or another suitable polarity changing device may be used to change the charge on the negative toner on the surface of second intermediate transfer member IT#3 to a positive charge. This preferably occurs prior to the arrival of the toner on the surface of the second intermediate transfer member IT#3 to the nip. This advantageously only requires one polarity of toner.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams. The claims should not be read as limited to the described order or elements unless stated to that effect.

In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

The invention claimed is:

1. A duplex imaging system to create a toner image or coating comprising:

a non-web first imaging assembly, including a first photoconductor, for imaging on a first side of a receiver material wherein the first imaging assembly includes a first split intermediate transfer roller having two or more portions that are electrically independent wherein each portion can be simultaneously biased to a different voltage for imaging, one or more portion having a first discharged area development mode;

a second imaging assembly including a second photoconductor, for imaging on a second side of the receiver material, wherein the second imaging assembly includes a second split intermediate transfer roller, including one or more portions having a second charged area development mode; and wherein the first and second imaging assemblies synchronously image on their respective sides of the receiver material utilizing one or more split intermediate transfer rollers separated into two or more portions with distinct electrical regions that are electrically isolated from each other such that each imaging assembly, with its respective intermediate transfer roller, has the ability to operate with independent operating modes and toner polarity.

2. The printing system of claim 1, wherein the first and second split intermediate transfer rollers are at least 2-up rollers.

3. The printing system of claim 1, wherein the first imaging assembly includes a first polarity toner and the second imaging assembly includes a second polarity toner.

4. A duplex imaging system to create a toner image or coating comprising:

a first imaging assembly, including a first photoconductor using discharged area development mode, for imaging on a first side of a receiver material wherein the first imaging assembly includes a first split intermediate transfer member having two or more portions that are electrically independent wherein each portion can be simultaneously biased to a different voltage for imaging, one or more portion having a first mode;

a second imaging assembly, including a second photoconductor using charged area development mode, for imaging on a second side of the receiver material, wherein the second imaging assembly includes a second split intermediate transfer member, including one or more portions having a second mode; and wherein the first and second imaging assemblies synchronously image on their respective sides of the receiver material utilizing one or more split intermediate transfer members separated into two or more portions with distinct electrically isolated regions such that each imaging assembly, with its respective intermediate transfer member, has the ability to operate with independent operating modes and toner polarity.

5. The printing system of claim 4, wherein the first and second split intermediate transfer members rotate with substantially the same angular velocity.

6. The printing system of claim 4, wherein the first and second split intermediate transfer members rotate with substantially the same surface velocity.

7. The printing system of claim 4, wherein the first and second split intermediate transfer members are both at least 2-up split rollers.

8. The printing system of claim 4, wherein the first intermediate split transfer member serves as a backup roller for the second intermediate split transfer member on a toning nip formed between the two intermediate split transfer members, and wherein the second intermediate split transfer member serves as a backup roller for the first intermediate split transfer member in a toning nip.

* * * * *